United States Patent [19]

Bellus et al.

[11] Patent Number: 4,670,374

[45] Date of Patent: Jun. 2, 1987

[54] PHOTOTHERMOGRAPHIC ACCELERATORS FOR LEUCO DIAZINE, OXAZINE, AND THIAZINE DYES

[75] Inventors: Peter A. Bellus, Minneapolis; Robert A. Frenchik, Somerset, both of Minn.

[73] Assignee: Minnesota Mining and Manufacturing Company, St. Paul, Minn.

[21] Appl. No.: 829,465

[22] Filed: Feb. 12, 1986

Related U.S. Application Data

[63] Continuation of Ser. No. 656,690, Oct. 1, 1984, abandoned.

[51] Int. Cl.[4] ..... G03C 7/26; G03C 1/06

[52] U.S. Cl. ..... 430/505; 430/523; 430/559; 430/560; 430/617; 430/619; 430/620; 430/351

[58] Field of Search ..... 430/617, 619, 620, 338, 430/341, 340, 344, 505, 523, 559, 560, 351

[56] References Cited

U.S. PATENT DOCUMENTS

| | | | |
|---|---|---|---|
| 2,646,367 | 6/1951 | Davis et al. | 117/36 |
| 3,447,944 | 6/1969 | Werner | 117/36.2 |
| 3,531,286 | 9/1970 | Renfrew | 96/67 |
| 3,708,304 | 1/1973 | Hiller | 430/353 |
| 3,985,565 | 10/1976 | Gabrielsen | 96/114.1 |
| 4,021,240 | 5/1977 | Cerquone et al. | 96/29 |
| 4,021,250 | 5/1977 | Sashihara et al. | 96/114.1 |
| 4,022,617 | 5/1977 | McGuckin | 430/617 |
| 4,152,160 | 5/1979 | Ikienoue et al. | 430/620 |
| 4,260,677 | 4/1981 | Winslow et al. | 430/618 |
| 4,309,255 | 1/1982 | Gendler et al. | 204/2 |
| 4,370,401 | 1/1983 | Winslow et al. | 430/341 |
| 4,374,921 | 2/1983 | Frenchik | 430/620 |
| 4,379,835 | 4/1983 | Lowrey et al. | 430/341 |
| 4,452,883 | 6/1984 | Frenchik et al. | 430/619 |

FOREIGN PATENT DOCUMENTS

| | | |
|---|---|---|
| 52-5239 | 1/1982 | Japan . |

OTHER PUBLICATIONS

Research Disclosure No. 17029, dated Jun. 1978, James W. Carpenter and Paul W. Lauf.

*Primary Examiner*—Won H. Louie

*Attorney, Agent, or Firm*—Donald M. Sell; James A. Smith; Lorraine R. Sherman

[57] ABSTRACT

A photothermographic construction comprises a light-sensitive color-forming element on a support base, the element comprising a silver source, optionally silver halide, a binder, and an oxidizable leuco phenazine, phenoxazine, or phenothiazine dye, and as development accelerator a carboxylic acid, Lewis acid, or Bronsted acid.

16 Claims, No Drawings

PHOTOTHERMOGRAPHIC ACCELERATORS FOR LEUCO DIAZINE, OXAZINE, AND THIAZINE DYES

This is a continuation of application Ser. No. 656,690, filed Oct. 1, 1984, now abandoned.

FIELD OF THE INVENTION

The present invention relates to silver halide photothermographic color constructions. In another aspect, it relates to two-or three-color separation photothermographic recording systems utilizing certain classes of leuco dyes as color formers.

BACKGROUND ART

Photothermographic imaging systems are those imaging materials which, upon first being exposed to light in an imagewise fashion, produce an image when subsequently heated. The exposure to light or other radiation photoactivates or photodeactivates a component in the imageable element and subsequent heating causes an image forming reaction to differentially occur in exposed and unexposed regions.

Silver halide photothermographic imaging materials, often referred to as "dry silver" compositions because no liquid development is necessary to produce the final image, have been known in the art for many years. These imaging material basically comprise a light-insensitive, reducible silver source, a light-sensitive material which generates silver when irradiated, and a reducing agent for silver ion in the silver source. The light-sensitive material is generally photographic silver halide which must be in catalytic proximity to the light-insensitive silver source. Catalytic proximity is an intimate physical association of these two materials which enables catalysis of the reduction of the silver source by silver specks formed on the silver halide. Exposure of the silver halide to light produces small clusters of silver atoms. The imagewise distribution of these clusters is known in the art as the latent image. This latent image generally is not visible by ordinary means and the light-sensitive article must be further processed in order to produce a visual image. The visual image is produced by the catalytic reduction of silver ions which, as already noted, are in catalytic proximity to the specks of the latent image.

The silver source used in this area of technology is a material which contains a reducible source of silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

Color-forming, "dry silver" imaging systems are known in the photographic art. Color-formation is based on the oxidation/reduction reaction between the light-exposed silver salt of a fatty acid which has been halidized and dye-sensitized to a specific wavelength and is used with a chromogenic developer in the presence of elevated temperature. For example, U.S. Pat. No. 3,531,286 teaches the inclusion of color coupler components such as a p-phenylenediamine developer and a phenolic or active methylene coupler in close proximity to the light-sensitive emulsion. J. W. Carpenter and P. W. Lauf, Research Disclosure No. 17029, issued June 1978, review prior art relating to photothermographic silver halide systems which include color formation.

U.S. Pat. No. 4,021,240 discloses the use of sulfonamidophenol reducing agents and four equivalent photographic color couplers in thermographic and photothermographic emulsions to produce dye images including multicolor images.

U.S. Pat. No. 3,985,565 discloses the use of certain class of phenolic type photographic color couplers in photothermographic emulsions to provide a color image.

U.S. Pat. No. 4,021,250 discloses the use of 0.0025 percent leuco thiazine dye as a shelf life extender in a photothermographic system comprising an organic silver salt, a catalytic amount of a photosensitive silver halide, a reducing agent, and a binder. The example disclosed used 1.87 percent chlorothymol and 0.126 percent phthalazinone as the image producing reactants.

Leuco methylene blue, a thiazine dye, is known to be useful in recording systems. U.S. Pat. No. 2,646,367 discloses a carbonless copy system using, for example, benzoyl leuco methylene blue as the color forming agent. U.S. Pat. No. 3,447,944 discloses a thermographic copy system utilizing leuco methylene blue and its derivatives as color former. U.S. Pat. No. 4,309,255 relates to leuco methylene blue in electrochromic recording paper.

Japanese laid-open patent document 59-5239 discloses a 2-sheet, positive-acting, light-sensitive, heat-developable, diffusion, image transfer construction.

SUMMARY OF THE INVENTION

Briefly, the present invention comprises a single-sheet, negative-acting photothermographic construction having a light-sensitive color-forming element on a support base, the element comprising a light-sensitive and non light-sensitive silver source, optionally silver halide, a binder, and an oxidizable leuco phenazine, phenoxazine, or phenothiazine dye, and as development accelerator a carboxylic acid, Lewis acid or Bronsted acid. Any oxidizable leuco phenazine, phenoxazine, or phenothiazine dye known in the art is useful in the present invention. The oxidized forms can have colors ranging from turquoise to yellow.

The photothermographic portion of the element can be any imageable layer or layers which are photosensitive and developable by being heated (e.g., on a heated drum roll or by exposure to infrared radiation), preferably in the tempeature range of 150° to 350° F. (approximately 65° to 180° C.). Particularly important are silver halide photothermographic systems comprising silver halide, a silver source material in catalytic proximity to the silver halide, and a reducing agent for silver ion in a binder, these systems being commonly known as 'dry silver' construction. These systems may be in a single layer or in a plurality of layers as is well known in the art.

The color-forming element of the present invention can be useful in a two or three color separation photothermographic recording system. In such a system it may be required to provide in a topcoat layer a "barrier polymer" which is impervious to an upper adjacent color layer. Such constructions are described, for example, in patent application U.S. Ser. No. 475,441 (U.S.

Pat. No. 4,460,681, filed Mar. 15, 1983, and in U.S. Pat. No. 4,452,883.

Novel leuco phenoxazine and phenothiazine dyes which are oxidizable to forms have purple to yellow colors (i.e., λmax of less than 600 nm) are useful in the present invention and are disclosed in assignee's copending patent application, U.S. Ser. No. 656,460, filed the same date as this application. Novel useful phenazine dyes are disclosed in Assignee's copending patent application, U.S. Ser. No. 656,580, filed the same date as this application).

In the present application:

"leuco dye" means a colorless or lightly colored dye which can be oxidized to a colored form;

"aryl" means phenyl or naphthyl;

"arylene" means phenylene or naphthylene;

"lower alkyl" means alkyl containing 1 to 4 carbon atoms:

"lower alkoxy" means alkoxy containing 1 to 4 carbon atoms;

"aliphatic" means a straight-chain or branched-chain hydrocarbon;

"halogen" means fluorine, chlorine, bromine or iodine; and

"in association with" means in the same layer or in a layer contiguous thereto. For example, the location of the photosensitive silver halide in the photothermographic element or composition of the invention is such that will enable catalytic action. The described photosensitive silver halide can accordingly be in the same layer as or in a layer contiguous to the described oxidation-reduction image-forming combination (i.e., the silver salt oxidizing agent such as silver behenate or silver stearate and the reducing agent and development modifier of the present invention).

DETAILED DESCRIPTION

The present invention comprises a single-sheet, negative-acting, photothermographic element on a support base, said element comprising a silver source, optionally silver halide, a leuco dye as reducing agent for silver ion, a binder, and a development accelerator, wherein (a) said leuco dye comprises a phenazine, phenothiazine, or phenoxazine leuco dye having the formula

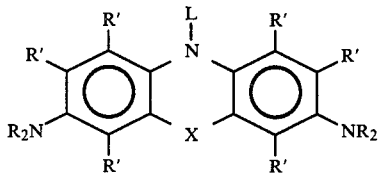

wherein

X can be —S—, —O—, or —NQ—;

each R can be the same or different and is independently selected from (1) hydrogen, (2) an unsubstituted aryl or alkyl group or these groups substituted by up to four groups selected from alkyl, alkoxy, cyano, hydroxy, halogen, nitro, mercapto, alkylsulfonyl, arysulfonyl, and Z, where Z is as defined below, wherein all alkyl and alkoxy groups have 1 to 20 carbon atoms, and preferably are lower alkyl and alkoxy, and (3) Z, wherein Z can be $$-\overset{O}{\overset{\|}{C}}Q,\ -\overset{O}{\overset{\|}{C}}-OQ,\ -\overset{O}{\overset{\|}{C}}NHQ,\ -SO_2Q,\ \text{and}\ -\overset{O}{\overset{\|}{C}}NQ_2,$$

wherein each Q can be the same or different and is independently selected from (1) hydrogen, (2) an unsubstituted aryl or alkyl group or these groups substituted by up to four groups selected from alkyl, alkoxy, cyano, hydroxy, halogen, nitro, mercapto, alkylsulfonyl, arysulfonyl, and Z, where Z is as defined above, wherein all alkyl and alkoxy groups have 1 to 20 carbon atoms, and preferably are lower alkyl and alkoxy; and R′ is the same or different and can be independently selected from hydrogen, halogen, alkyl or alkoxy of 1 to 6 carbon atoms or by these groups substituted by up to 3 halogen atoms; and L can be Z or hydrogen;

with the proviso that R and L can have up to a total of 5 carbonyl and sulfonyl groups, preferably up to 3 carbonyl and sulfonyl groups; and (b) said development accelerator comprises at least one aliphatic or aromatic carboxylic acid or anhydrides thereof, Lewis acid, or Bronsted acid selected from (1) a carboxylic acid having the formula $$R^{10}(COOH)_n$$

wherein n is an integer having the value 1 to 4, preferably 1 to 3, $R^{10}$ is a group which is unsubstituted or substituted by at least one group selected from amino, hydroxyl, aryl, lower alkyl, lower alkoxy, cyano sulfonyl, mercapto, nitro, halogen, and Z, wherein Z is as defined above, wherein when n is 1, $R^{10}$ is selected from the group consisting of alkyl, alkenyl, aryl, and phenylalkyl, all having up to 10 carbon atoms, and when n is 2, 3, or 4, $R^{10}$ is selected from the group consisting of alkenylene, alkylene, and arylene, all having up to 14 carbon atoms:

(2) a Lewis acid preferably selected from halide, nitrate, sulfate, sulfonate, and carboxylate salts such as ammonium and alkyl-substituted ammonium nitrates, nitrates of Ni, Zn, Al, Cu, and Hg, and chloride of mercury II; and (3) Bronsted acid preferably selected from sulfonic and sulfinic acids, phenols, phosphonic and phosphinic acids, and sulfimides.

The above-defined leuco dyes can have a molecular weight up to 2000, preferably up to 700, and the carboxylic acids can have a molecular weight up to 500, preferably up to 400.

The preferred photothermographic construction of the present invention is of the "dry silver" type. The color-forming element which can provide an image ranging from cyan to yellow, including, magenta, red, violet, purple or blue can be of unitary construction or the light-sensitive layer may be in association with the leuco dye, i.e., in a bilayer construction. Single layer constructions must contain the silver source material, the silver halide, the developer, and the development accelerator in the same layer. In a bilayer construction the light-sensitive layer has a topcoat layer which comprises the leuco dye and acid material. Dry silver bilayer constructions must contain the silver source and silver halide in one emulsion layer (usually the layer adjacent the substrate). The other ingredients can be in the same layer, a second layer, or both layers. Optional additional materials include toners, coating aids, and other adjuvants.

Photothermographic color constructions of the present invention incorporate at least one spectrally-sensitized color-forming element according to the present invention to produce a single or multi-color photothermographic color recording system. When at least two color-forming elements are present, the spectral sensitization may be to a pair of colors such as two of black, yellow, red, green, blue, and purple provided that each color-forming element is sensitized to a portion of the spectrum at least 60 nm different from the other color-forming element(s), and each color-forming layer forms a visible dye having a maximum absorbance at least 60 nm different from that of the dye formed in the other color-forming element(s). Preferred pairs of colors to which the construction may be sensitized are yellow-cyan, yellow-magenta, and cyan-magenta. Preferably, a barrier polymer which is impervious to the solvent system of a color construction above it is coated between each pair of color-forming layers. Such a barrier polymer or barrier polymers are essential for the production of good color separation. The test for determining if a barrier polymer is impermeable to the solvent of the next layer can be simply performed. Such a test is described in U.S. Pat. No. 4,452,883 and is incorporated herein by reference. The photothermographic color construction may comprise three different monocolor-forming layers to provide a 3-color forming system.

The oxazine and thiazine leuco dyes and dyes of the invention can be prepared as is known in the art by acylation of an unsubstituted phenoxazine or phenothiazine compound to provide an N-acylated phenoxazine or phenothiazine compound. Nitration, in acetic acid, as is known in the art provides, after recrystallization, the 3,7-dinitro phenoxazine or phenothiazine compound. Hydrogenation catalyzed by platinum metal gives the corresponding diamino compounds. Treatment of the diamino compound with the appropriate alkylating or acylating reagent at room temperature in the presence of a base such as pyridine, triethylamine, or sodium hydroxide, gives the diamino substituted leuco dye. To prepare leuco phenazine dyes useful in the present invention a phenylene diamine compound, e.g., N,N-dimethyl p-phenylenediamine and an aniline compound, e.g., N,N-dimethylaniline are combined in a solvent, preferably water, in a reaction vessel and stirred, preferably at room temperature. It is preferred that the reaction be conducted in an aqueous acidic environment. A second aniline compound, e.g., 4-methylaniline is then added to the mixture. The resulting mixture is then stirred and heated for a sufficient period of time to bring about formation of the dye product in free form. To the solution is added an ionizable halide salt, e.g., KI, NaCl, to precipitate the dye product. The solution is then cooled, and the dye collected by filtration and dried in air. Reduction in water in the presence of a water-soluble reducing agent, e.g., sodium dithionite, provides a hydrogen leuco dye. Extraction in a non-reactive water-insoluble solvent (e.g., methylene dichloride) and treatment of the organic portion with a reactive halide compound (e.g., benzoyl chloride) gives the leuco dye.

In a preferred embodiment wherein the photothermographic construction is of the dry silver type, the silver source material, as mentioned above, may be any material which contains a reducible source of silver ions. Silver salts of organic acids, particularly long chain (10 to 30, preferably 15 to 28, carbon atoms) fatty carboxylic acids are preferred. Complexes of organic or inorganic silver salts wherein the ligand has a gross stability constant for silver ion of between 4.0 and 10.0 are also desirable. The silver source material should constitute from about 5 to 70 and preferably from 7 to 30 percent by weight of the imaging layer. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

Where the construction has more than one color-forming element, the dyes formed from the leuco dyes in the various color-forming layers should of course be different. A difference of at least 60 nm in reflective or transmissive maximum absorbance is required. Preferably the absorbance maximum of dyes formed will differ at least 80 or 100 nm. When three dyes are to be formed, two should differ by at least these minimums, and the third should differ from at least one of the other dyes by at least 150 nm and preferably at least 200 or even at least 250 nm. This will provide a good, full color range for the final image.

In the present invention, the reducing agent (developer) for silver ion is..the leuco phenazine, phenoxazine, or phenothiazine dye defined above which will reduce silver ion to metallic silver and produce a colored dye. Many representative examples of these dyes are given below in TABLES I and II. The reducing agent should be present as 0.1 to 10 percent by weight of the imaging layer. In a two-layer construction, if the reducing agent is in the second layer, slightly higher proportions, of from about 2 to 15 percent, tend to be more desirable.

Additional reducing agents can be useful. Conventional photographic developers such as phenidone, hydroquinones, and catechol are useful in minor amounts, and hindered phenol reducing agents may also be added. Other leuco dyes not specified above (e.g., Crystal violet) may be useful as an additional reducing agent in minor amounts (up to about one-half the amount of the primary reducing agent).

Toners such as phthalazinone and phthalazine and others known in the art are not essential to the construction, but may be desirable. These materials may be present, for example, in amounts of from 0.001 to 1 percent by weight.

The binder for the silver coating is selected from well-known natural and synthetic resins such as gelatin, polyvinyl acetals, polyvinyl chloride, polyvinyl acetate, cellulose acetate, ethyl cellulose, polyolefins, polyesters, polystyrene, polyacrylonitrile, polycarbonates, methacrylate copolymers, maleic anhydride ester copolymers, and butadiene-styrene copolymers, and the like. When simultaneous coating of layers is used, the binder is selected to coordinate with the solvent used. Copolymers and terpolymers which include the above-stated binders are of course included in these definitions. The preferred photothermographic silver containing binder is polyvinyl butyral. The binders are generally used in a range of from 20 to 75 percent by weight of each layer, and preferably about 30 to 55 percent by weight.

Development modifiers which can be useful in the present invention have been defined above. The acid chosen for a particular light-sensitive element depends on the activity of the leuco diazine, oxazine, or thiazine dye, i.e., upon its tendency to become oxidized to a colored form. More reactive leuco dyes require less acidic materials than to less readily oxidized leuco dyes. For example, Pergascript Turquoise TM (a more reactive leuco dye) requires phthalic acid whereas Copikem II TM (a less reactive leuco dye) requires a more reactive acid such as 4-nitrophthalic acid. Representative and preferred development modifiers include aromatic carboxylic acids and their anhydrides such as phthalic acid, benzoic acid, chlorinated and nitro-substituted benzoic acids, 1,2,4-benzenetricarboxylic acid, 2,3-naphthalene dicarboxylic acid, tetrachlorophthalic acid, 4-methyl phthalic acid, homophthalic acid, 4-nitrophthalic acid, o-phenylacetic acid, naphthoic acid, naphthalic acid, phthalic anhydride, naphthalic anhydride, tetrachlorophthalic anhydride, 3-nitrophthalic acid; aliphatic carboxylic acids such as malic acid, chloracetic acid, itaconic acid, tartaric acid, benzoylformic acid, and thiodiacetic acid; Bronsted acids, e.g., sulfonic acids such as p-toluene sulfonic acid, phosphonic and phospninic acids, phenols such as 2,4-dinitrophenol, 2,6-dinitrophenol, and pentachlorophenol, and other acidic materials such as sulfimides (e.g., saccharin); or Lewis acids including nitrate salts such as nickel nitrate, copper nitrate, mercury nitrate, zinc nitrate, aluminum nitrate, or ammonium nitrate.

Sensitizing dyes useful in the present invention include many compounds known in the art, as well as 454
(prepared as in U.S. Pat. No. 2,493,748)

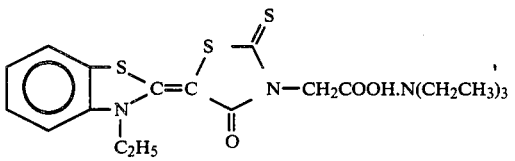

Erythrosin
(Aldrich Chemical Co., Milwaukee, WI)

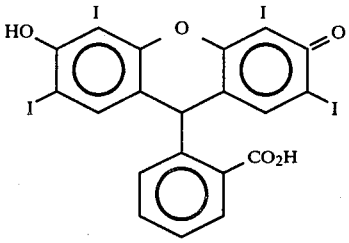

563
(prepared as in U.S. Pat. No. 3,719,495)

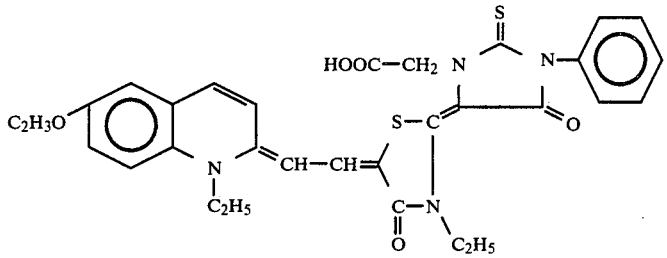

421
(prepared as in U.S. Pat. No. 3,719,495)

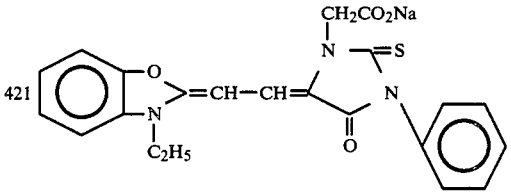

The support base or substrate is a transparent or opaque polymeric film. Preferably it is made of such materials as polyester [e.g., poly(ethyleneterephthalate)], cellulose ester (e.g., cellulose acetate, cellulose acetate butyrate, cellulose acetate propionate), polyolefins, polyvinyl resins, and the like. Paper can also be used.

The coatings can either be made as single layers, as for example by knife-coating or extruding, and dried before the next layer is applied or each monocolor can be dual coated, as for example by dual slide-coating or dual extrusion, i.e., each of the sensitized silver layers with its respective topcoat, which may contain a barrier resin, can be coated together to reduce the number of passes through the coater.

Representative examples of useful leuco diazine, oxazine, and thiazine dyes are given in TABLES I and II below with the Dmin and Dmax values for the bilayer element which was prepared as follows:

| Silver Solution | |
|---|---|
| silver behenate | 1.7 g |
| toluene | 9.3 g |
| methyl ethyl ketone (MEK) | 3.1 g |

These 3 components were homogenized. Separately added were:

| | |
|---|---|
| toluene | 71.1 g |

-continued

| | |
|---|---|
| ethanol | 6.5 g |
| polyvinyl butyral resin (Butvar TM B-76, Monsanto Corp.) | 8.3 g |

Mixing was continued until the Butvar dissolved. Then 1 ml of a solution of 4.3 g $ZnCl_2$ dissolved 100 ml ethanol was added and mixing continued for 1 hour. The dispersion was coated at 76 micrometer (3 mil) orifice (wet thickness) on a super calendered 691B Simpson TM photographic paper (Simpson Paper Co., vicksburg, MI) using a knife coater. The coating was dried 4 minutes at 85° C. (185° F.).

| Topcoat Preparation | |
|---|---|
| ethanol | 50.0 g |
| acetone | 42.5 g |
| Butvar B-76 | 7.5 g |

-continued

| Topcoat Preparation | |
|---|---|
| UV absorber (Cyasorb TM UV 5411 American Cyanamid) | 0.1 g |
| phthalic acid | 0.5 g |

The five components were mixed until dissolution occured. To individual samples (8 g) of the topcoat solution 0.05 g of each of the leuco dyes listed in TABLES I and II below were added with mixing. All coatings were at 76 micrometer (3 mil) wet thickness using a Bird applicator over individual samples of the above-described dried silver coating. The construction was dried either at 15 min. at room temperature (21° C.), designated condition A, or 3 min. at 85° C. (185° F.), designated condition B. The construction was exposed 20 sec. to approximately 3800 fc using a 3M Model 636 tungsten lamp and then developed at 124° C. (255° F.) for the specified time on a heated blanket processor.

TABLE I

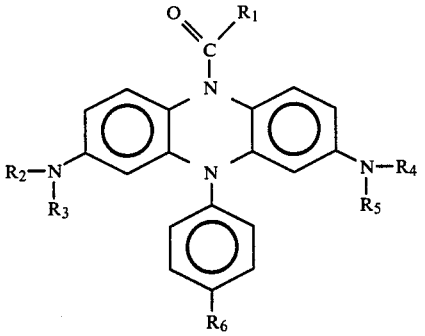

| Sample | $R_1$ | $R_2$ | $R_3$ | $R_4$ | $R_5$ | $R_6$ | Color | Dmin | Dmax | Drying condition | Processing time (sec) |
|---|---|---|---|---|---|---|---|---|---|---|---|
| 1 | 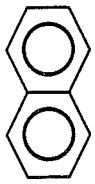 | $C_2H_5$ | $C_2H_5$ | $C_2H_5$ | $C_2H_5$ | H | purple | 0.82 | 1.19 | A | 10* |
| 2 | 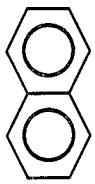 | $C_2H_5$ | $C_2H_5$ | H | 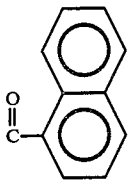 | H | magenta | 0.09 | 0.28 | A | 10* |
| 3 | 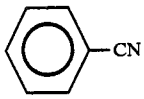 | $C_2H_5$ | $C_2H_5$ | $C_2H_5$ | $C_2H_5$ | H | purple | high | | A | 10 |
| 4 | 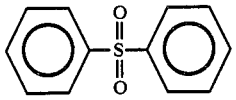 | $CH_3$ | $CH_2CF_3$ | $CH_3$ | $CH_2CF_3$ | $CH_3$ | magenta | 0.17 | 0.19 | A | 60 |
| 5 | 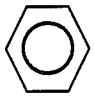 | $CH_3$ | $CH_2CF_3$ | $CH_3$ | $CH_2CF_3$ | $CH_3$ | magenta | 0.56 | 1.21 | A | 10 |

TABLE I-continued

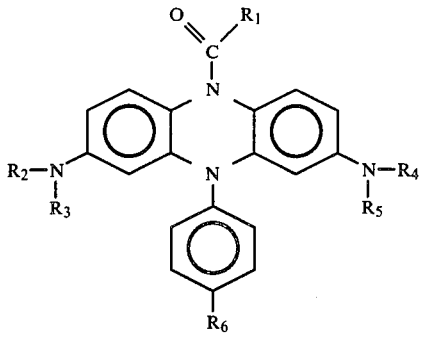

| Sample | $R_1$ | $R_2$ | $R_3$ | $R_4$ | $R_5$ | $R_6$ | Color | Dmin | Dmax | Drying condition | Processing time (sec) |
|---|---|---|---|---|---|---|---|---|---|---|---|
| 6 | 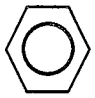 | $CH_3$ | $CH_2CF_3$ | $CH_3$ | $CH_2CF_3$ | H | magneta | 0.82 | 1.31 | A | 10 |
| 7 | $OC_2H_5$ | $CH_3$ | $CH_2CF_3$ | $CH_3$ | $CH_2CF_3$ | $CH_3$ | purple | 0.43 | 0.96 | B | 30 |
| 8 | 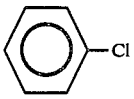 | $CH_3$ | $CH_2CF_3$ | $CH_3$ | $CH_2CF_3$ | $OCH_3$ | magenta | 0.55 | 2.55 | A | 10 |
| 9 | 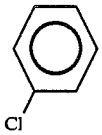 | $CH_3$ | $CH_3$ | $CH_3$ | $CH_3$ | $OCH_3$ | purple | 0.21 | 1.02 | A | 9 |
| 10 | 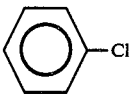 | $CH_3$ | $CH_3$ | $CH_3$ | $CH_3$ | $OCH_3$ | purple | 1.05 | 1.92 | A | 5 |
| 11 | 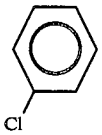 | $CH_3$ | $CH_3$ | $CH_3$ | $CH_3$ | $CH_3$ | purple | 0.38 | 1.84 | A | 9** |
| 12 | 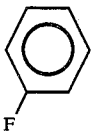 | $CH_3$ | $CH_3$ | $CH_3$ | $CH_3$ | $CH_3$ | purple | 0.68 | 1.88 | A | 2 |
| 13 | 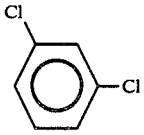 | $CH_3$ | $CH_3$ | $CH_3$ | $CH_3$ | $OCH_3$ | purple | 0.30 | 1.51 | A | 2 |
| 14 | 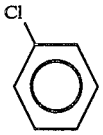 | $CH_3$ | $CH_2CF_3$ | $CH_3$ | $CH_2CF_3$ | $OCH_3$ | purple | 0.20 | 0.58 | B | 2½ min. |

*135° C. (275° F.)
**116° C. (240° F.)

TABLE II

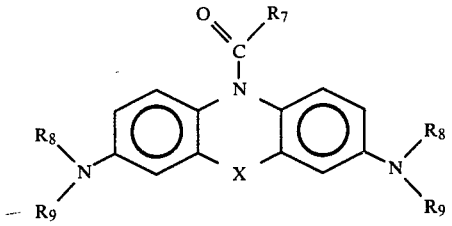

| Sample | $R_7$ | $R_8$ | $R_9$ | X | Color | Dmin | Dmax | Drying | Time |
|---|---|---|---|---|---|---|---|---|---|
| 15 | H | H | $\overset{O}{\overset{\|\|}{C}}OO$ | S | magenta | 0.70 | 1.88 | A | 10* |
| 16 | $CH_3$ | H | H | O | green | 0.29 | 0.50 | A | 6 |
| 17 | 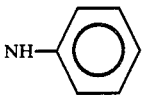 | $CH_3$ | $CH_3$ | S | green | — | — | A | 10 |
| 18 | H | H | $\overset{O}{\overset{\|\|}{C}}NHCH_2CH_2CH$ | S | blue-gray | — | — | A | 10 |
| 19 | 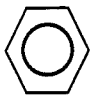 | H | H | O | green | 0.21 | 0.84 | A | 10 |
| 20 | $CH_3$ | H | $\overset{O}{\overset{\|\|}{C}}NHC_4H_9$ | O | green | — | — | A | 20 |
| 21 | $CH_3$ | H | $COOC_2H_5$ | S | magenta | — | — | A | 20 |
| 22 | 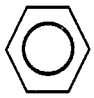 | H | $COOC_2H_5$ | O | red | — | — | A | 30 |
| 23 | $NHC_4H_9$ | H | $COOC_2H_5$ | O | purple | 0.57 | 0.98 | A | 5 |
| 24 | H | H | $\overset{O}{\overset{\|\|}{C}}CF_3$ | O | — | 1.50 | 1.78 | A | 2 |
| 25 | $NHC_4H_9$ | H | $\overset{O}{\overset{\|\|}{C}}CF_3$ | O | red-orange | 0.35 | 1.07 | A | 30 |
| 26 | H | H | $SO_2CH_3$ | O | orange | 1.89 | 2.09 | A | 3 |
| 27 | $NHC_4H_9$ | H | $\overset{O}{\overset{\|\|}{C}}CCl_3$ | O | pink | 0.29 | 0.50 | A | 15 |
| 28 | $NHC_4H_9$ | H | $\overset{O}{\overset{\|\|}{C}}CH_2Cl$ | O | orange | 0.34 | 1.20 | A | 20 |
| 29 | $NHC_4H_9$ | $CH_3$ | $\overset{O}{\overset{\|\|}{C}}CF_3$ | O | purple | 0.35 | 0.64 | B | 25 |
| 30 | $NHC_4H_9$ | H | $\overset{O}{\overset{\|\|}{C}}CHCl_2$ | O | pink | 0.40 | 0.48 | A | 20 |
| 31 | $CH_3$ | H | $CH_2CF_3$ | O | blue | 0.18 | 0.57 | B | 3 min. |

TABLE II-continued

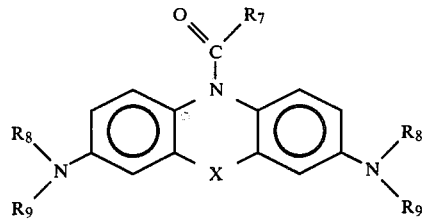

| Sample | $R_7$ | $R_8$ | $R_9$ | X | Color | Dmin | Dmax | Drying | Time |
|---|---|---|---|---|---|---|---|---|---|
| 32 | 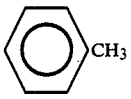 | $CH_3$ | $CH_3$ | S | blue-green | 0.53 | 2.19 | A | 80 |

*135° C. (275° F.)

Objects and advantages of this invention are further illustrated by the following examples, but the particular materials and amounts thereof recited in these examples, as well as other conditions and details, should not be contrued to unduly limit this invention.

In the examples the dyes used have the structre:

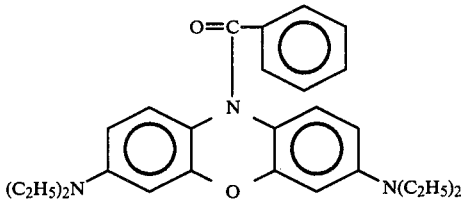

Pergascript Turquoise TM
(leuco oxazine)
S-2G
(Ciba-Geigy)
CYAN

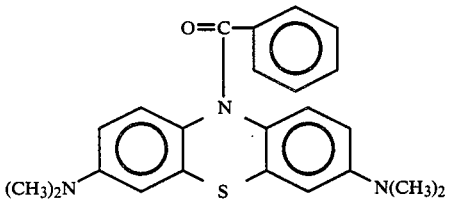

Copikem II TM
(leuco thiazine)
(Hilton-Davis)
CYAN

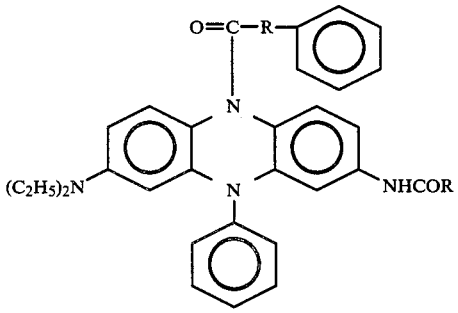

*Leuco Diazine A
(3M)
MAGENTA

Preparation of Leuco Diazine A 10 g of Heliotrope B dye

-continued

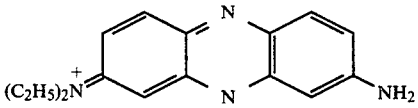

(Pfaltz and Bauer Chemical Co., Stamford, CT) was dissolved in 250 ml of water under a nitrogen blanket. Sufficient sodium dithionite was added until all of the color was discharged. 200 ml of methylene chloride was added and the solution was stirred vigorously with a mechanical stirrer. 8 g of benzoyl chloride was added and the pH of the aqueous phase was adjusted to 10 while stirring was maintained for 3 hours. At this time the methylene chloride layer was separated, washed with water, diluted with potassium carbonate solution and again with water. The solution was dried over $MgSO_4$ and the solvent removed under vacuum yielding a crude product. This material was recrystallized from acetone to give the product leuco diazine A.

EXAMPLE 1

The leuco oxazine dye, Pergascript Turquoise S-2G, was tested for photothermographic imaging using it in a silver soap system in the absence of a metal halide with a Lewis acid as development accelerator.

Silver Soap Dispersion 1A

| | Material | Amount |
|---|---|---|
| Grind charge | | |
| A | silver behenate full soap | 8.0 g |
| B | Butvar B76 | 0.1 g |
| C | ethanol | 17.99 g |
| D | toluene | 37.89 g |
| ballmill time | | 23 hours |
| Let Down charge | | |
| E | toluene | 36.02 g |
| ballmill time | | 1 hour |

The above solution was milled in an 240-ml glass jar half filled with 12.7 mm glass balls.

Finished Silver Soap Coating Solution 1B

The following materials were mixed toqether and coated onto a baryta coated paper at 0.1016 mm (4 mils) and air dried.

| Charge | Material | Amount |
|---|---|---|
| A | silver soap dispersion 1A | 69.6 g |
| B | toluene | 98 ml |
| C | ethanol | 15 ml |
| D | Butvar B76 | 15 g |
| E | fluorochemical surfactant (FC 431, 3M) | 0.2 g |

Topcoat Formulation

The following solution was prepared to evaluate some acid development modifiers.

Master solution 1C

| Charge | Material | Amount |
|---|---|---|
| A | Pergascript Turquoise S-2G | 0.625 g |
| B | Cyasorb UV 5411 TM (UV absorber, American Cyanamid) | 0.125 g |
| C | ethanol | 12.50 ml |
| D | 10 wt. % Butvar B76 in acetone | 50.0 g |

Effect of Nickel Nitrate

A 0.5 ml solution of 0.1 g of nickel nitrate dissolved in 5 ml of methanol and 5 ml of n-methylpyrrolidone was added to 5 g of example master solution 1C (no acid) and also to 5 g of example master solution 1C containing m-nitrobenzoic acid (0.075 g per 12.1 g master solution 1C). These solutions were coated at 0.1016 mm onto silver soap coating 1B and air dried. The results are shown in TABLE III.

TABLE III

| Sample | UV exposure Time (sec.) | Dev. time 124° C. (sec.) | Dmin | Dmax |
|---|---|---|---|---|
| 1. no acid | 10 | 20 | 0.12 | 0.32 |
| | 30 | 10 | 0.11 | 0.43 |
| | 90 | 10 | 0.12 | 0.62 |
| 2. m-nitrobenzoic acid | 30 | 1.5 | 0.42 | 0.76 |

The data of TABLE III show nickel nitrate acts as a development catalyst without the use of an additional carboxylic acid catalyst.

EXAMPLE 2

Silver Soap Solution 2A

A halide sensitized silver soap solution was prepared using the example 2A silver soap homogenate as follows:

| Charge | Material | Amount |
|---|---|---|
| A | silver soap coating solution 1B | 60 g |
| B | 4.32 g zinc chloride dissolved in 100 ml of ethanol | 0.6 ml |

This was coated at 0.0762 mm onto 0.0508 mm (2 mil) thick titanium oxide filled polyester film and air dried.

Topcoat Master Solution 2B

A topcoat master solution was made as follows:

| Charge | Material | Amount |
|---|---|---|
| A | 15 wt. % Butvar B-76 in acetone | 100 g |
| B | ethanol | 127 cc |
| C | Cyasorb UV 5411 | 0.2 g |

Run using Pergascript Turquoise

Then 0.125 grams of Pergascript Turquoise S2G was added to 10 grams of topcoat master solution 2B. The development modifiers were added and the resulting solutions were coated at 0.1524 mm (6 mils) onto silver soap coating 2A and air-dried. The resulting coated material was then exposed to UV light and developed at 124° C. The results are shown in TABLE IV below.

TABLE IV

| Sample | Development modifier | UV exposure time (sec.) | Dev. Time 124° C. (sec.) | Dmin | Dmax | Image color |
|---|---|---|---|---|---|---|
| 1 | 0.05 g phthalic acid | 40 | 20 | 0.25 | 0.16 | green |
| 2 | 0.05 g 4-nitro-phthalic acid | 40 | 2 | 0.25 | 1.52 | green |
| 3 | 5 mg nickel nitrate dissolved in 0.5 ml methanol | 40 | 2.5 | 0.32 | 1.02 | blue |
| 4 | 0.5 mg nickel nitrate dissolved in 0.5 ml methanol | 40 | 30 | 0.16 | 0.36 | green |

Run using Copikem-II and Leuco Diazine A

Using the same procedure runs using Copikem-II or Leuco Diazine A in place of the Pergascript Turquoise-S2G were made. The results are shown in TABLE V below.

TABLE V

| Sample | Leuco dye | Development modifier | UV exposure time(sec.) | Dev. time 124° C. (sec.) | Dmin | Dmax | Image color |
|---|---|---|---|---|---|---|---|
| 1 | 0.125 g Copikem-II | 0.05 g 4-nitro-phthalic acid | 40 | 20 | 0.16 | 1.07 | blue green |
| 2 | 0.06 g Leuco Diazine A | 0.05 g phthalic acid | 40 | 15 | 0.47 | 1.64 | maroon |
| 3 | 0.06 g Leuco Diazine A | 0.05 g 4-nitro-phthalic acid | 40 | 10 | 0.76 | 1.24 | maroon |

The data of TABLES I and V demonstrate the usefulness of various acids as development accelerators with oxazine, thiazine, and diazine leuco dyes in a silver halide-containing photothermographic system.

EXAMPLE 3

Silver Behenate premix 3A

A silver behenate half soap dispersion was by dispersing 300 grams in 2696 ml of ethanol and 347 ml of toluene by rapid mixing. This dispersion was then homogenized on a Manton-Gaulin Model 15M 8TBA SND homogenizer (Manton-Gaulin Co.) using two passes at 550 kg/cm$^2$ (8000 psi) and 225 kg/cm$^2$ (4000 psi). Then 389.8 grams of this material were diluted with 113 ml of ethanol. Mixing in 34.7 grams of polyvinyl butyral polymer (Butvar-B76) for 1 hour finished this premix.

Pergascript Turquoise-S2G Plus Acid in Silver Soap Coating 3B

Evaluation was made of the effect of acid on the oxidation-reduction reaction between Pergascript Turquoise and silver behenate half soap. The following formulation was used for this evaluation.

| Ingredient | Amount |
|---|---|
| A. Silver Behenate Premix 3A | 30.0 g |
| B. ethanol | 6.0 ml |
| C. 5.72 g calcium bromide in 100 ml ethanol | 0.4 ml |
| D. 5 g acid (see TABLE VI) in 100 ml acetone | 3.0 ml |
| E. 10 g Pergascript Turquoise-S2G in 100 ml toluene | 3.0 ml |

These solutions were coated at 0.1016 mm onto 0.0508 mm thick titanium oxide filled polyester (3M) and air dried 3 minutes plus 3 minutes 82° C. (180° F.). Then exposed for 120 seconds to the "Violite" (Allied Litho Supply Co., San Francisco, CA) UV light source (General Electric 15 watt blacklight) through a continuous step tablet. Then processed at 127° C. (260° F.) on a 3M Model 70 heat blanket processor for 1 to 20 seconds. The densities were measured on a Macbeth densitometer using a red filter. The acids tested are listed in following TABLE VI below.

TABLE VI

| Acid | Development Time @ 127° C. (sec.) | Red Dmin | Filter Dmax | Image color |
|---|---|---|---|---|
| 1. phthalic | 75 | 0.22 | 1.32 | green |
| 2. 4-nitrophthalic | 1 | 0.52 | 1.36 | blue |

The 4-nitrophthalic acid was re-evaluated with the addition of 0.4 ml of 0.57 9 of mercuric chloride per 100 ml of ethanol and the same repeated with the addition of 3.0 ml of 5 g of Ionox TM (R) 201 antioxidant (Shell Chemical Company) to the test solution formulation. These solutions were coated and tesred in the same manner as previous samples. The results are listed in TABLE VII below.

TABLE VII

| Sample | Development Time @ 127° C. (sec.) | Red Dmin | Filter Dmax) | Image color |
|---|---|---|---|---|
| 1. control | 1 | 0.52 | 1.36 | blue |
| 2. with mercuric chloride | 2 | 0.18 | 1.44 | blue |
| 3. with mercuric chloride and "Ionox 201" | 2 | 0.31 | 1.66 | blue |

The data of TABLE VII show that mercuric chloride can be used as a Lewis acid type development accelerator and as an antifoggant in the present invention with or without an antioxidant.

Copikem-II Plus Acid In Silver Behenate Coating

Evaluation of the effect of different acids on the oxidation-reduction reaction between Copikem-II and silver behenate half soap was made. The following formulation was used for this evaluation:

| Ingredient | Amount |
|---|---|
| A. silver behenate premix 3A | 30.0 g |
| B. ethanol | 3.0 ml |
| C. 5.72 g calcium chloride in 100 ml ethanol | 0.4 ml |
| D. acid | 0.15 g |
| E. acetone | 3.0 ml |
| F. 5 g Copikem-II in 100 ml toluene | 6.0 ml |

These solutions were coated, dried, and processed as described in Example 3B. The acids are listed in TABLE VIII below.

TABLE VIII

| Acid | Development time @127° C. (sec.) | Red filter Dmin | Red filter Dmax) | Image color |
|---|---|---|---|---|
| 1. phthalic | 90 | 0.19 | 0.27 | yellow |
| 2. 4-nitrophthalic | 20 | 0.64 | 0.97 | blue |
| 3. 4-chlorophthalic | 55 | 0.22 | 0.48 | green |

Leuco Diazine A Plus Acids and Toners in Silver Behenate Coating

Evaluation was made of the effect of acid on the oxidation-reduocton reaction using Leuco Diazine A and silver behenate half soap. The following formulation was used for this evaluation:

Leuco Diazine A Plus Acid and Toners in Silver Behenate Coating

| Ingredient | Amount |
|---|---|
| A. silver behenate premix 3A | 30.0 g |
| B. ethanol | 4.0 ml |
| C. 0.57 g mercuric chloride in 100 ml ethanol | 0.4 ml |
| D. 5.7 g calcium chloride in 100 ml ethanol | 0.4 ml |
| E. 5 grams acid in 100 ml ethanol | 3.0 ml |
| F. 6 grams Leuco Diazine A in 100 ml acetone plus 1.2 ml NMP (N—methylpyrrolidone) | 3.0 ml |

These solutions were coated, dried, and processed as described in 3B. The materials evaluated are listed in TABLE IX below. Measurements were made using a green filter.

TABLE IX

| Test Material | Development Time 127° C. (sec.) | Green filter Dmin | Green filter Dmax | Image Color |
|---|---|---|---|---|
| 1. phthalic acid | 15 | 0.16 | 1.28 | Magenta |
| 2. *phthalazinone plus phthalic acid | 10 | 0.15 | 1.38 | Magenta |

*(used 1.5 ml of 2.5 g phthalazinone in 100 ml methanol)

The data of TABLE IX shows that a combination of phthazinone plus phthalic acid gave a higher image density than phthalic acid alone.

EXAMPLE 4 - metal nitrate evaluation with leuco oxazine dye

Silver Behenate Premix 4A

A silver behenate premix was prepared to use in evaluating use of metal nitrate with oxazine and thiazine leuco dyes in a dye sensitized, silver halide containing silver behenate half soap system. The silver behenate homogenate 3A was used.

| Ingredients | Amount |
|---|---|
| A. silver behenate homogenate 3A | 389.8 g |
| B. N—methylpyrrolidone (NMP) | 2.4 ml |
| C. toluene | 6.0 ml |
| D. ethanol | 104.0 ml |
| E. 0.5 g Butvar-B76 in 100 ml ethanol | 0.9 ml |
| F. Butvar-B76 | 34.6 g |

Sensitized Silver Behenate Premix 4B and 4C

The solution premix 4A was halidized and dye sensitized to green light using the following formulation:

| Ingredients | Amount 4B | Amount 4C |
|---|---|---|
| A. silver behenate premix 4A | 50 g | 50 g |
| B. ethanol | 20 ml | 20 ml |
| C. 0.57 g mercuric bromide in 100 ml ethanol | 0 | 0.7 ml |
| D. 5.72 g calcium bromide in 100 ml ethanol | 0.7 ml | 0.7 ml |
| E. 0.1 g RP 421 dye in 100 ml ethanol | 1.3 ml | 1.3 ml |

This solution was coated at 0.0508 mm onto 0.0508 mm thick titanium oxide filled polyester (3M) and dried for 3 minutes at 77° C. (170° F.). This was used to evaluate the metal nitrates used in a topcoat containing the leuco dye, phthalic acid, and a polymer.

Topcoat Master Solution 4D

A topcoat master solution containing Pergascript Turquoise for Lewis acid (nitrate) evaluation was prepared using the following:

| Ingredients | Amount |
|---|---|
| A. 10 wt. percent CAB-553-0-4 in ethanol (Eastman-alcohol soluble cellulose acetate butyrate) | 120.0 g |
| B. phthalic acid | 0.6 g |
| C. *Pergascript Turquoise-S2G | 1.2 g |
| D. N—methylpyrrolidone | 12.2 g |

*The leuco dye was predissolved in the N—methylpyrrolidone before mixing it with the polymer solution.

Topcoat Solution 4E

The nitrate salts were predissolved in methanol at a concentration of 1 gram per 100 ml. These were added to topcoat master solution 4D to give an equivalent concentration of $2.34\times10^{-5}$ moles of metal nitrate per 30 grams of solution. The nitrates which were evaluated are shown in TABLE X with the amounts used in milligrams.

TABLE X

| Compound (1 g/100 ml methanol) | Amount (mg/30 grams topcoat) |
|---|---|
| nickel nitrate | 6.8 |
| aluminum nitrate | 8.8 |
| ammonium nitrate | 1.9 |

These topcoat solutions were individually coated on top of silver behenate coatings 4B and 4C at an orifice setting of 0.1016 mm and dried for 5 minutes at 77° C. (170° F.). They were exposed for $10^{-3}$ seconds to Xenon flash (EG&G sensitometer) through a continuous tone wedge, then heat developed for 20 seconds at 124° C. (255° F.) on 3M Model 70 Heat Blanket Processor. The resulting wedges were measured on a computer densitometer using a red filter. The results are shown in TABLES XI and XII below.

TABLE XI (Silver Behenate Premix 4B)

| Sample | nitrate | Dmin | Dmax | Gamma angle | Sensitivity at 0.4 density/fog (ergs/cm$^2$) |
|---|---|---|---|---|---|
| 1 | none | .06 | 0.60 | 21° | 782 |
| 2 | nickel | .11 | 1.53 | 41° | 250 |
| 3 | aluminum | .16 | 1.44 | 27° | 140 |
| 4 | ammonium | .08 | 1.22 | 31° | 174 |

TABLE XII (Silver Behanate Premix 4C)

| Sample | nitrate | Dmin | Dmax | Gamma angle | Sensitivity at 0.4 density/fog (ergs/cm$^2$) |
|---|---|---|---|---|---|
| 5 | none | .07 | 1.40 | 40° | 873 |
| 6 | nickel | .06 | 2.16 | 57° | 449 |
| 7 | aluminum | .09 | 2.04 | 53° | 252 |
| 8 | ammonium | .07 | 2.16 | 55° | 659 |

The data of TABLE XI show that the Lewis acid (nitrate) improved the thermal reactivity of the system resulting in higher image densities, gamma angles, and light sensitivity. The image color of the above systems was blue to cyan.

EXAMPLE 5 - nickel nitrate and nickel bromide evaluation as development accelerator with leuco thiazine dye.

Sensitized Silver Behenate Premix 5A

The solution premix 4A prepared in EXAMPLE 4 was halidized and dye sensitized to green light using the following formulation:

| Ingredients | Amount |
|---|---|
| A. silver behenate premix 4A | 200.0 g |
| B. 0.57 g mercuric bromide in 100 ml ethanol | 2.8 ml |
| C. 5.72 g calcium bromide in 100 ml ethanol | 2.8 ml |
| D. 1.79 g mercuric acetate in 28 ml methanol | 2.8 ml |
| E. 0.10 g #421 dye in 100 ml ethanol | 5.2 ml |

This solution was coated at 0.0508 mm onto 0.508 mm thick titanium oxide filled polyester and dried for 3 minutes at 77° C. (170° F.).

Topcoat Master Solution 5B

A topcoat master solution containing Copikem-II for metal nitrate evaluation was prepared using the following formulation:

| Ingredients | Amount |
|---|---|
| A. 10 wt. percent CAB-553-0-4 in ethanol | 160.0 g |
| B. 4-nitrophthalic acid | 0.8 g |
| C. Copikem-II | 1.6 g |
| D. N—methylpyrrolidone (Predissolve Copikem-II in (D) before addition to (A). | 16.43 g |

Nickel Nitrate Evaluation

Nickel nitrate and phthalic acid were individually predissolved in methanol at a concentration of 1 gram per 100 ml. Then 0.5 ml of these solutions were added to individual 22.354 gram portions of topcoat master solution 5B. These topcoat solutions were coated over a sensitized silver behenate coating 5A at an orifice setting of 0.1016 mm and dried for 5 minutes at 77° C. (170° F.). They were exposed, processed, and tested as in EXAMPLE 4. The results are shown in TABLE XIII below:

TABLE XIII

| Sample No. | Additive | Development time @ 124° C. (sec.) | Dmin | Dmax | Gamma angle | Sens. @ 0.4 density/fog (ergs/cm$^2$) |
|---|---|---|---|---|---|---|
| 1 | phthalic acid | 90 | 0.14 | 0.93 | 25 | 3,818 |
| 2 | nickel nitrate | 90 | 0.16 | 1.35 | 44 | 1,000 |

The data demonstrate the effectiveness of a nitrate salt as development accelerator.

EXAMPLE 6 - combination of other leuco dyes with leuco oxazine and thiazine dyes

Topcoat Master Solution 6A

A topcoat master solution containing 4-nitrophthalic acid and leuco crystal violet was made to evaluate the effect of combining the oxazine and thiazine leuco dyes with nickel nitrate. The following formulation was used:

| Ingredients | Amount |
|---|---|
| A. 10 wt. percent CAB-553-0-4 in ethanol | 200.0 g |
| B. 4-nitrophthalic acid | 1.0 g |
| C. leuco Crystal Violet (Aldrich Chemical Co.) | 0.2 g |

The Pergascript Turquoise, Copikem-II, and nickel nitrate were predissolved in solvents then added to 20.12 grams of the example topcoat master solution 4G. The following solutions were prepared:

| Ingredients | Amounts 1 | 2 | 3 | 4 |
|---|---|---|---|---|
| H. master solution 6A | 20.12 g | 20.12 g | 20.12 g | 20.12 g |
| B. 1.0 g Pergascript Turquoise-S2G per 6 ml N—methylpyrrolidone | 1.2 ml | 1.2 ml | 1.8 ml | 0 |
| C. 1.0 g Copikem-II per 10 ml N—methylpyrrolidone | 1.0 ml | 1.0 ml | 0 | 3.0 ml |
| D. 1.0 g nickel nitrate per 100 ml methanol | 0 | 0.5 ml | 0.5 ml | 0.5 ml |

These solutions were coated at 0.0762 mm onto silver behenate coating 5A and dried for 5 minutes at 77° C. (170° F.). They were exposed, processed, and tested as in Example 4. The results are shown in TABLE XIV below.

TABLE XIV

| Sample No. | Combination with leuco crystal violet | Development time @ 124° C. (sec.) | Dmin | Dmax | Gamma angle | Sens. @ 0.4 density/fog (ergs/cm$^2$) |
|---|---|---|---|---|---|---|
| 1 | Pergascript Turquoise and Copikem-II | 20 | 0.26 | 1.63 | 58° | 960 |
| 2 | Pergascript Turquoise and Copikem-II nickel nitrate | 20 | 0.27 | 2.01 | 69° | 580 |
| 3 | Pergascript Turquoise nickel nitrate | 20 | 0.43 | 1.62 | 49° | 480 |
| 4 | Copikem-II nickel nitrate | 60 | 0.22 | 1.05 | 33° | 1260 |

All images were bluish-green in color. The data of TABLE XIV show that the combination of the leuco dyes of the invention in combination with other leuco dyes and nickel nitrate gave useful systems.

EXAMPLE 7

Effect of Phthalazine

The effect of phthalazine was evaluated using the following formulations 7A and 7B:

| Ingredients | Amounts 7A | 7B |
|---|---|---|
| A. 10 wt. % CAP-553-0.4 in ethanol | 29.9 g | 29.9 g |
| B. 1.2 g Pergascript Turquoise-S2G in 12 ml N—methylpyrrolidone | 3.0 ml | 3.0 ml |
| C. phthalic acid | 0.30 g | 0.30 g |
| D. 4-nitrophthalic acid | 0.05 g | 0.05 g |
| E. tetrachlorophthalic acid | 0.03 g | 0.03 g |
| F. phthalazine | 0 | 0.03 g |

These solutions were coated 0.1016 mm thick onto Silver Behenate Coating 4C and dried for 5 minutes at 77° C. (170° F.). They were exposed, processed, and tested as in Example 4. The results are shown in TABLE XV below.

TABLE XV

| Development solution no. | Description | Time 124° C. (sec.) | Dmin | Dmax | Gamma angle | Sens. @ 0.4 density/fog (ergs/cm$^2$) |
|---|---|---|---|---|---|---|
| 7A | control | 15 | 0.11 | 2.13 | 58° | 163 |
| 7B | with phthalazine | 60 | 0.08 | 1.68 | 38° | 1422 |

The samples were aged for two hours using 2152 milliphots (2000 foot candles), 27° C. (80° F.), and 60 percent relative humidity. The changes in Dmin are shown in TABLE XV.

TABLE XVI

| Solution no. | Initial Dmin | 2 Hour Dmin | Delta Dmin |
|---|---|---|---|
| 7A | 0.13 | 0.93 | +0.80 |
| 7B | 0.12 | 0.49 | +0.37 |

The data of TABLES XV and XIV show that conventional development modifiers used in dry silver are also useful in this system. Although phthalazine reduces the thermal reactivity it improves the print stability.

The use of phthalazine with nickel nitrate and Pergascript Turquoise was evaluated in the following formulation.

| Ingredients | Amounts 7C | Amounts 7D |
|---|---|---|
| A. 10 wt. % CAB-553-0.4 in ethanol | 18.55 g | 18.55 g |
| B. phthalic acid | 0.093 g | 0.093 g |
| C. 4-nitrophthalic acid | 0.028 g | 0.028 g |
| D. 1.2 g Pergascript Turquoise-S2G in 7.2 ml NMP | 1.10 ml | 1.10 ml |
| E. 2.0 g nickel nitrate in 100 ml methanol | 0 | 0.46 ml |
| F. 5.0 g phthalazine in 100 ml ethanol | 0 | 0.24 ml |

These solutions were coated at 0.1016 mm onto Silver Behenate Coating 4C and dried for 5 minutes at 77° C. (170° F.). They were exposed, processed, and tested as in EXAMPLE 4D. The results are shown in TABLE XVII below.

TABLE XVII

| Solution no. | Description | Development time @124° C. (sec.) | Dmin | Dmax | Gamma Angle | Sens. @ 0.4 density/fog (ergs/cm$^2$) | 2 hour print stability Dmin delta |
|---|---|---|---|---|---|---|---|
| 7C | control | 20 | 0.20 | 2.44 | 60° | 122 | 0.55 |
| 7D | nickel nitrate plus phthalazine | 60 | 0.19 | 2.25 | 62° | 242 | 0.33 |

The data of TABLE XVII show the increased density and sensitivity of the nickel nitrate/phthalazine containing construction. When compared to phthalazine alone, the addition of nickel nitrate was not detrimental to print stability but did improve sensitometry.

EXAMPLE 8 - Acids with Oxazine Dye

Cyan Silver Coating 8A (below) was prepared and coated at 3.6 g/m$^2$ (0.32 grams per square foot) onto 0.076 mm thick polyester film MELINEX TM TYPE 329 (ICI) using a laboratory hand knife coater. Various acids were used in the construction with the leuco oxazine dye, Pergascript Turquoise S-2G.

Cyan Silver Coating 8A

| Charge | Material | Amount |
|---|---|---|
| A | Cyan Silver Coating 3B (Example 3) | 90 grams |
| B | ethanol | 36 cc |
| C | 0.36 g mercuric bromide in 100 cc methanol | 2 cc |
| D | 4.0 g calcium bromide in 100 cc methanol | 1.8 cc |
| E | 0.017 g MSD 563 Dye (see above) in 50 cc methanol | 2.9 cc |

0.064 mm (2.5 mil) orifice; dried 5 min at 82° C. (180° F.)

The following formulation was used to evaluate acids in a topcoat over the precoated red sensitive silver coating (8A).

Cyan Topcoat Solution 8B

| Charge | Material | Amount |
|---|---|---|
| A | 10% by weight CAB-553-0 | 25 g |
| B | acid to be tested | 0.3 or 0.4 g |
| C | (FC431, 3M) fluorochemical surfactant | 1 drop |

The topcoat was coated at a 0.076 mm orifice and dried for 5 minutes at 82° C. (180° F.). The material was then exposed for $10^{-3}$ seconds to an EG&G xenon flash sensitometer. No filter was used. The samples were processed at 124° C. (255° F.) on a 3M Model 70 heated blanket processor. The dwell times, Dmin and Dmax, are noted with the acid tested in TABLE XX below.

TABLE XX

| Acid | Conc. g/25 g Topcoat | Dwell time (sec) | Dmin | Dmax |
|---|---|---|---|---|
| I. AROMATIC MONOCARBOXYLIC ACIDS | | | | |
| 1. benzoic | 0.3 | 60 | 0.08 | 0.10 |
| 2. salicylic | 0.4 | 20 | 0.45 | 1.75 |
| 3. 3-chlorobenzoic | 0.4 | 60 | 0.27 | 0.39 |
| 4. 2-chloro-4-nitrobenzoic | 0.4 | 10 | 0.33 | 2.36 |
| | | 20 | 0.73 | 3.05 |
| 5. 2,4-dichlorobenzoic | 0.4 | 10 | 0.17 | 1.67 |
| | | 20 | 0.23 | 2.08 |
| II. AROMATIC DICARBOXYLIC ACIDS | | | | |
| 1. phthalic | 0.3 | 20 | 0.08 | 2.00 |
| 2. homophthalic | 0.4 | 60 | 0.08 | 0.98 |
| 3. phthalic anhydride | 0.4 | 20 | 0.08 | 2.03 |
| 4. 4-methylphthalic | 0.4 | 20 | 0.09 | 2.47 |
| 5. 4-nitrophthalic | 0.4 | 20 | 0.10 | 1.76 |
| 6. 3-nitrophthalic | 0.4 | 60 | 0.08 | 0.63 |
| 7. tetrachlorophthalic acid | 0.4 | 20 | 0.11 | 0.51 |
| 8. tetrachlorophthalic anhydride | 0.4 | 60 | 1.59 | slight image - |

TABLE XX-continued

| Acid | Conc. g/25 g Topcoat | Dwell time (sec) | Dmin | Dmax |
|---|---|---|---|---|
| | | | | high fog |
| 9. saccharin | 0.4 | 60 | 0.10 | 0.55 |
| III. ALIPHATIC DICARBOXYLIC ACIDS | | | | |
| 1. maleic | 0.4 | 20 | 0.18 | 2.23 |
| 2. itaconic | 0.3 | 60 | 0.08 | 0.76 |
| 3. glutaconic | 0.4 | 60 | 0.10 | 0.43 |
| 4. dichloromaleic | 0.4 | 20 | 0.10 | 2.65 |
| 5. malic | 0.3 | 60 | 0.10 | 0.98 |
| 6. tartaric | 0.3 | 60 | 0.08 | 0.48 |
| IV. ALIPHATIC POLYCARBOXYLIC ACIDS | | | | |
| 1. citric | 0.4 | 60 | 0.09 | 1.04 |
| V. NITRATE SALTS | | | | |
| 1. zinc | 0.006 | 60 | 0.28 | 0.87 |
| 2. ammonium | 0.006 | 60 | 0.20 | 0.45 |
| VI. POLYAROMATIC DICARBOXYLIC ACIDS | | | | |
| 1. 2,3-naphthalene dicarboxylic acid | 0.4 | 60 | 0.12 | 1.32 |

The data of TABLE XX show the usefulness of various acids as development accelerator with Pergascript Turquoise S-2G in color constructions.

EXAMPLE 9

Cyan Oxazine Leuco Dye Developer in Magenta/Cyan Bipack

A dispersion of a silver behenate half soap was made at 10% by weight in a solvent mixture of 90% toluene and 10% ethanol using two passes with a Manton-Gaulin homogenizer, Model 15M, at 550 kg/cm$^2$ and 225 kg/cm$^2$ (8000 and 4000 psi). This silver soap dispersion is then prepared for coating by the addition of dilution solvents, halide, polymer, and sensitizing dye in a selected sequence of time and mixing.

Magenta Silver Coating 9A

| Charge | Material | Amount | Add time (min.) |
|---|---|---|---|
| A | 10% Ag half soap homogenate (90 toluene/10 ethanol) | 177 g | |
| B | toluene | 175 g | |
| C | Butvar B-76 (polyvinyl butyral) | 0.1 g | 10 |
| D | mercuric acetate solution (4 g/100 cc methanol) | 3 cc | 20 |
| E | mercuric bromide solution (0.36 g/100 cc methanol) | 3 cc | 30 |
| F | calcium bromide solution (4 g/100 cc methanol) | 3 cc | 35 |
| G | C | 0.1 g | 75 |
| H | E | 3 cc | 95 |
| I | F | 3 cc | 100 |
| J | C | 78 g | 220 |
| K | 10% by weight Butvar B76 in toluene | 335 g | 280 |

Stop mixing at 340 minutes. 90 grams of EXAMPLE 1 were dye sensitized with 2.7 cc of a #534 dye (green light sensitizer) solution with a concentration of 0.013 g dye/50 cc methanol. This solution was coated on top of a 0.05 mm (2 mil) thick titanium dioxide filled polyester film (3M) using a 0.076 mm 3 mil orifice on a laboratory hand knife coater. This coating was dried at 81° C. (177° F.) for 5 minutes.

Magenta Topcoat 9B

The following topcoat solution was prepared to coat on top of Magenta Silver Coating 9A.

| Charge | Material | Amount |
|---|---|---|
| A | toluene | 34 cc |
| B | ethanol | 10 cc |
| C | phthalazinone | 0.16 g |
| D | tetrabromophthalic anhydride | 0.16 g |
| E | 30% by weight Acryloid-A21 TM (polymethylmethacrylate, Union Carbide) | 25 g |
| F | 30% by weight Acryloid-B44 TM (polymethylmethacrylate, Union Carbide) | 25 g |
| G | magenta leuco indoaniline dye | 0.52 g |

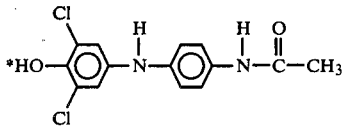

| | | |
|---|---|---|
| H | ethanol | 10 cc |

*8.15 g of 2,6 dichlorophenol and 15.9 g sodium carbonate were dissolved in 300 ml water; then, 150 ml chloroform were added. A solution of 65.9 g potassium ferricyanide in 300 ml water was added and the solution was stirred for 1 hour. The chloroform layer was separated, washed with 5% aqueous sodium hydroxide, dried with $MgSo_4$ and stripped to yield a dye. One gram of this dye was dissolved in 200 ml diethylether and 0.58 g of t-butyl-hydroquinone was added. The mixture was allowed to stand for 3 hours. The ether was extracted with 5% aqueous sodium hydroxide. The aqueous layer was separated and acidified with 10% hydrochloride acid. A precipitate formed. This suspension was extracted with ether. The ether was evaporated giving a tan material, the magenta leuco indoaniline dye.

This solution was coated on top of coating 9A using a 0.076 mm (3 mil) orifice and drying at 81° C. (177° F.) for 5 minutes.

A different dispersion of a silver behenate half soap was made similar to 9A, except that a solvent mixture of 90% ethanol and 10% toluene was used. This silver soap dispersion was used in preparing a red light sensitive coating for the cyan color system which was to be coated on top of the pre-coated magenta color forming system.

| Charge | Material | Amount |
|---|---|---|
| | Cyan Silver Premix 9C | |
| A | 10% Ag half soap homogenate (90 ethanol/10 toluene) | 390 g |
| B | ethanol | 104 cc |
| C | Butvar-B76 | 34 g |
| | Cyan Silver Coating 9D | |
| A | cyan silver premix 9C | 90 g |
| B | ethanol | 36 cc |
| C | mercuric bromide solution (0.36 g/100 cc methanol) | 2 cc |
| D | calcium bromide solution (4.0 g/100 cc methanol) | 1.8 gg |

50 grams of Cyan Silver Premix 9C solution were dye sensitized with 1.2 cc of MSD 563 dye (red light sensitizer) solution having a concentration of 0.017 grams/50 cc methanol. This was coated on top of the precoated 9A and 9B layers at an orifice of 0.05 mm (2 mils). The coating was dried at 81° C. (177° F.) for 5 minutes.

Cyan Color Topcoat 9D

The following topcoat solution was prepared to coat on top of Cyan Silver premix 9C to finish the magenta/cyan color bipack.

| Charge | Material | Amount |
|---|---|---|
| A | ethanol | 40 cc |
| B | phthalic acid | 0.50 g |

-continued

| Charge | Material | Amount |
|---|---|---|
| C | 4-nitrophthalic acid | 0.24 g |
| D | 15% by weight of CAB-553-0 in ethanol | 68 g |
| E | cyan leuco oxazine dye (Pergascript Turquoise-S-2G) | 1.0 g |
| E | toluene | 10 cc |

This was coated on top of Cyan Silver Premix 9C at an orifice of 0.1016 mm (4 mils) and dried for 5 minutes at 81° C. (177° F.). The magenta/cyan bipack was now complete and had the following construction:

Base
0.05 mm thick (2 mil) $TiO_2$ filled polyester
1st layer
green light sensitive silver
2nd layer
magenta color developer & development modifiers in barrier polymer
3rd layer
red light sensitive silver
4th layer
cyan color developer & development modifiers in hard topcoat polymer.

This material was exposed to an EG&G (EG&G, Electrooptics Div., Salem, MA) xenon flash sensitometer using the proper light filtration to generate the mono-magenta and mono-cyan colors. A Wratten Number 58 and a Wratten Number 25 were used. The exposed material was then processed at 124° C. (255° F.) for 20 seconds.

The sensitometry of the bipack is given in TABLE XVIII below.

TABLE XVIII

| Filter | #58 (Green) | #25 (Red) |
|---|---|---|
| Dmin | 0.26 | 0.23 |
| Dmax | 1.57 | 2.20 |
| gamma angle | 54 | 65 |
| ergs/cm$^2$ at 0.6 density/fog | 64 | 21 |
| image color | magenta | cyan |

The data of TABLE XVIII shows that a good color separation was obtained and demonstrates the utility of a two-color system.

EXAMPLE 10

Example of Cyan Oxazine Leuco Dye Developer in Yellow/Magenta/Cyan Tripack

The following will illustrate a three color separation system employing the cyan oxazine leuco dye, pergascript Turquoise.

Yellow Silver Coating 10A

This solution was prepared by adding 1.5 cc of a #454 dye (blue sensitizer) solution having a concentration of 0.032 grams per 50 cc of methanol to 40 grams of Magenta Silver Coating 9A. This was coated at a 0.1016 mm (4 mil) orifice using a laboratory hadn knife coater onto a 0.0508 mm thick (2 mil) titanium dioxide filled polyester film (3M). The coating was dried for 5 minutes at 81° C. (177° F.).

Yellow Topcoat Resin premix 10B

| Charge | Material | Amount |
|---|---|---|
| A | 10% by weight PVP-K90 (polyvinylpyrrolidone, GAF Corp.) in methanol | 75 g |
| B | 25% by weight Gantrez-ES225 (copolymer methyl vinyl ether/maleic acid, GAF Corp.) in 50% ethanol & 50% methanol | 25 g |
| C | 2-amino-2-methyl-1-propanol | 0.275 g |

Charges B and C were mixed together prior to addition to charge A.

Yellow Topcoat Coating 10C

| Charge | Material | Amount |
|---|---|---|
| A | methanol | 12 cc |
| B | 2,2',6,6'-tetramethyl-4,4'-biphenol prepared as described in U.S. Pat. No. 4,374,921 | 0.3 g |
| C | phthalic acid | 0.04 g |
| D | 4-methyl-phthalic acid | 0.08 g |
| E | tetrachlorophthalic acid | 0.05 g |
| F | phthalazine | 0.125 g |
| G | resin premix 10B | 40 g |

Charges B through F were predissolved in charge A before addition of charge G. This solution was coated on top of precoated Yellow Silver Coating 9A at a 0.076 (3 mil) orifice and dried for 5 minutes at 79° C. (175° C.).

The magenta color forming systems 9A and 9B described in Example 8 were coated on top of the yellow color forming system described above. The resulting material was exposed and processed using the procedure of Example 9. A Wratten Number 47B (blue light) was used for the yellow color.

The sensitometry of this yellow/magenta bipack is given in TABLE XIX below.

TABLE XIX

| Filter | #47B (Blue) | #58 (Green) |
|---|---|---|
| Dmin | 0.30 | 0.31 |
| Dmax | 1.79 | 1.50 |
| gamma angle | 50° | 53° |
| ergs/cm$^2$ at 0.6 density/fog | 27 | 25 |
| image color | yellow | magenta |

The cyan color forming system utilizing Cyan Silver premix 9C and Cyan Silver Coating 9D was coated on top of the yellow/magenta bipack. The sensitometry for the yellow, magenta, and cyan were obtained by the same methods just described. The results showed a good three color separation for copying in color. The sensitometry for the yellow did not change from the bipack and the magenta and cyan were the same as disclosed in the magenta/cyan bipack.

Various modifications and alterations of this invention will become apparent to those skilled in the art without departing from the scope and spirit of this invention, and it should be understood that this invention is not to be unduly limited to the illustrative embodiments set forth herein.

We claim:

1. A single-sheet, negative-acting photothermographic construction comprising at least one light-sensitive color-forming element on a support base, the element comprising a light-sensitive and a non light-sensitive silver source, a binder, an oxidizable leuco phenazine, phenoxazine, or phenothiazine dye as the sole reducing agent for said silver sources, present as 0.1 to 10 percent by weight of the imaging layer, or 2 or 15 weight percent if the reducing agent is in the second layer of a two-layer construction, in an amount sufficient to provide color, and as development accelerator a carboxylic acid, a Lewis acid selected from the group consisting of halide, nitrate, sulfate, sulfonate, and carboxylate salts, or a Bronsted acid selected from the group consisting of sulfonic and sulfinic acids, phenols, phosphonic and phosphinic acids, and sulfimides; wherein the image color is provided by the oxidized form of said leuco dye.

2. The construction according to claim 1 wherein said light-sensitive silver source is silver halide.

3. The construction according to claim 1 wherein said element is of unitary construction.

4. The construction according to claim 1 wherein said element is a bilayer construction.

5. A single-sheet, negative-acting photothermographic construction comprising at least one light-sensitive color-forming element on a support base, said element comprising a silver source, silver halide, a leuco dye as the sole reducing agent for said silver source and silver halide present as 0.1 to 10 percent by weight of the imaging layer, or 2 to 15 weight percent if the reducing agent is in the second layer of a two-layer construction, in an amount sufficient to provide color, a binder, and a development accelerator, (a) said leuco dye comprising a phenazine, phenotiazine, or phenoxazine leuco dye having the formula

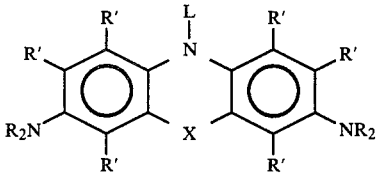

wherein each R is the same or different and is independently selected from (1) hydrogen, (2) an unsubstituted aryl or alkyl group or these groups substituted by up to four groups selected from alkyl, alkoxy, cyano, hydroxy, [halogen,] alkylsulfonyl, arylsulfonyl, a halogen atom, and Z where Z is as defined below, wherein all alkyl and alkoxy groups have 1 to 20 carbon atoms, and (3) Z, wherein Z is $$-\overset{O}{\overset{\|}{C}}Q,\ -\overset{O}{\overset{\|}{C}}-OQ,\ -\overset{O}{\overset{\|}{C}}NHQ,\ -SO_2Q,\ \text{and}\ -\overset{O}{\overset{\|}{C}}NQ_2,$$

wherein each Q is the same or different and is independently selected from (1) hydrogen, (2) an unsubstituted aryl or alkyl group or these groups substituted by up to four groups selected from alkyl, alkoxy, cyano, hydroxy, alkylsulfonyl, arylsulfonyl, a halogen atom, and Z, where Z is as defined above, and wherein all alkyl and alkoxy groups have 1 to 20 carbon atoms;

R′ is the same or different and is independently selected from hydrogen, halogen, or an alkyl or alkoxy group of 1 to 6 carbon atoms or these groups substituted by up to 3 halogen atoms; and X is —S—, —O—, or —NQ—;

L is hydrogen or Z;

with the proviso that R and L can have up to a total of 5 carbonyl and sulfonyl groups; and (b) said development accelerator comprising at least one of (1) a carboxylic acid having the formula $$R^{10}(COOH)_n$$

wherein n is an integer having the value 1 to 4, $R^{10}$ is a group which is unsubstituted or substituted by at least one group selected from amino, hydroxyl, aryl, lower alkyl, lower alkoxy, cyano, sulfonyl, mercapto, nitro, a halogen atom, and Z, wherein Z is as defined above, wherein when n is 1, $R^{10}$ is selected from the group consisting of alkyl, alkenyl, aryl, and phenylalkyl groups having up to 10 carbon atoms, and when n is 2, 3, or 4, $R^{10}$ is selected from the group consisting of alkenylene, alkylene, and arylene groups having up to 14 carbon atoms;

(2) a Lewis acid selected from the group consisting of halide, nitrate, sulfate, sulfonate, and carboxylate salts; and (3) a Bronsted acid selected from the group consisting of sulfonic and sulfinic acids, phenols, phosphonic and phosphinic acids, and sulfimides;

wherein the image color is provided by the oxidized form of said leuco dye.

6. The construction according to claim 5 wherein said leuco dye is

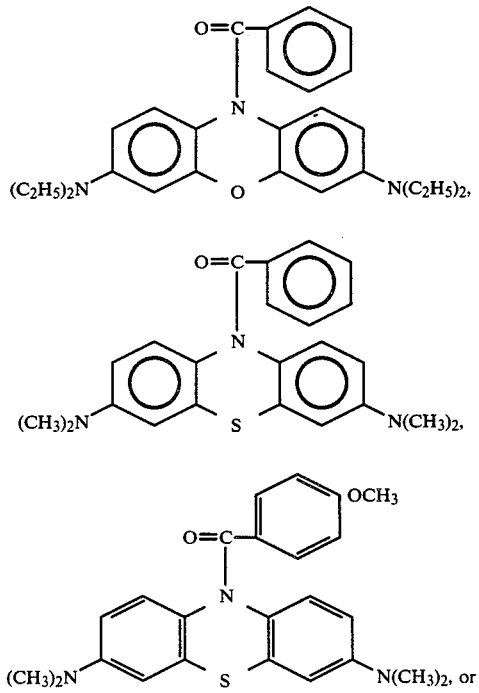

-continued

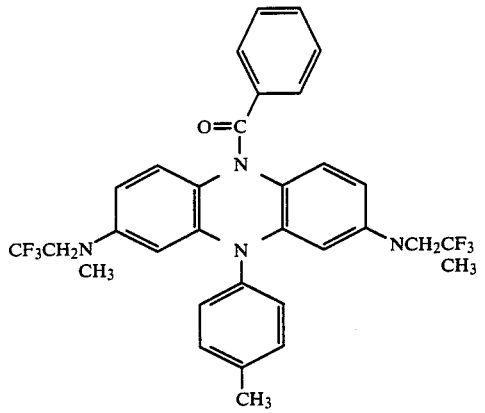

7. The construction according to claim 5 wherein said development accelerator is a carboxylic acid.

8. The construction according to claim 5 wherein said development accelerator is a Lewis acid.

9. The construction according to claim 5 wherein said development accelerator is a Bronsted acid.

10. The construction according to claim 5 wherein said carboxylic acid is selected from substituted benzoic or naphthoic acid.

11. The construction according to claim 5 wherein said Lewis acid is selected from nitrates of Ni, Zn, Al, Cu, Hg, and $NH_4+$.

12. The construction according to claim 5 wherein said color-forming element has a unitary layer construction.

13. The construction according to claim 5 wherein said color-forming element has a bilayer construction.

14. The construction according to claim 1 which is a 2- or 3-color separation recording system.

15. A single-sheet, negative-acting, photothermographic construction comprising at least one light-sensitive color-forming element on a support base, the element comprising a light-sensitive and a non light-sensitive silver source, a binder, a reducing agent consisting of an oxidizable leuco phenazine, phenoxazine, or phenothiazine dye present as 0.1 to 10 percent by weight of the imaging layer, or 2 to 15 weight percent if the reducing agent is in the second layer of a two-layer construction, in an amount sufficient to provide color, and as development accelerator a carboxylic acid, a Lewis acid selected from the group consisting of halide, nitrate, sulfate, sulfonate, and carboxylate salts, or a Bronsted acid selected from the group consisting of sulfonic and sulfinic acids, phenols, phosphonic and phosphinic acids, and sulfimides; wherein the image color is provided by the oxidized form of said leuco dye.

16. A single-sheet, negative-acting photothermographic construction comprising at least one light-sensitive color-forming element on a support base, said element comprising a silver source, silver halide, a reducing agent for said silver source and silver halide consisting of an oxidizable leuco dye present as 0.1 to 10 percent by weight of the imaging layer, or 2 to 15 weight percent if the reducing agent is in the second layer of a two-layer construction, in an amount sufficient to provide color, a binder, and a development accelerator, (a) said leuco dye comprising a phenazine, phenothiazine, or phenoxazine leuco dye having the formula

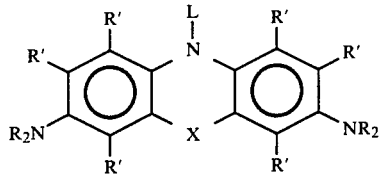

wherein each R is the same or different and is independently selected from (1) hydrogen, (2) an unsubstituted aryl or alkyl group or these groups substituted by up to four groups selected from alkyl, alkoxy, cyano, hydroxy, alkylsulfonyl, arylsulfonyl, a halogen atom, and Z where Z is as defined below, wherein all alkyl and alkoxy groups have 1 to 20 carbon atoms, and (3) Z, wherein Z is $$-\overset{O}{\overset{\|}{C}}Q,\ -\overset{O}{\overset{\|}{C}}-OQ,\ -\overset{O}{\overset{\|}{C}}NHQ,\ -SO_2Q,\ \text{and}\ -\overset{O}{\overset{\|}{C}}NQ_2,$$

wherein each Q is the same or different and is independently selected from (1) hydrogen, (2) an unsubstituted aryl or alkyl group or these groups substituted by up to four groups selected from alkyl, alkoxy, cyano, hydroxy, alkylsulfonyl, a halogen atom, arylsulfonyl and Z, where Z is as defined above, and wherein all alkyl and alkoxy groups have 1 to 20 carbon atoms;

R′ is the same or different and is independently selected from hydrogen, halogen, or an alkyl or alkoxy group of 1 to 6 carbon atoms or these groups substituted by up to 3 halogen atoms; and X is —S—, —O—, or —NQ—;

L is hydrogen or Z;

with the proviso that R and L can have up to a total of 5 carbonyl and sulfonyl groups; and (b) said development accelerator comprising at least one of (1) a carboxylic acid having the formula $$R^{10}(COOH)_n$$

wherein n is an integer having the value 1 to 4, $R^{10}$ is a group which is unsubstituted or substituted by at least one group selected from amino, hydroxyl, aryl, lower alkyl, lower alkoxy, cyano, sulfonyl, mercapto, nitro, a halogen atom, and Z, wherein Z is as defined above, wherein when n is 1, $R^{10}$ is selected from the group consisting of alkyl, alkenyl, aryl, and phenylalkyl groups having up to 10 carbon atoms, and when n is 2, 3, or 4, $R^{10}$ is selected from the group consisting of alkenylene, alkylene, and arylene groups having up to 14 carbon atoms;

(2) a Lewis acid selected from the group consisting of halide, nitrate, sulfate, sulfonate, and carboxylate salts; and (3) a Bronsted acid selected from the group consisting of sulfonic and sulfinic acids, phenols, phosphonic and phosphinic acids, and sulfimides;

wherein the image color is provided by the oxidized form of said leuco dye.

* * * * *